US007980962B2

(12) United States Patent
Fujimoto

(10) Patent No.: US 7,980,962 B2
(45) Date of Patent: Jul. 19, 2011

(54) GOLF CLUB AND GRIP FOR GOLF CLUB

(75) Inventor: Hiroaki Fujimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 135 days.

(21) Appl. No.: 12/363,255

(22) Filed: Jan. 30, 2009

(65) Prior Publication Data

US 2009/0298607 A1 Dec. 3, 2009

(30) Foreign Application Priority Data

May 30, 2008 (JP) ..... 2008-142018

(51) Int. Cl.
*A63B 53/14* (2006.01)

(52) U.S. Cl. ..... 473/300

(58) Field of Classification Search ..... 473/300–303
See application file for complete search history.

(56) References Cited

U.S. PATENT DOCUMENTS

| | | | | | |
|---|---|---|---|---|---|
| 1,611,925 | A | * | 12/1926 | Link | 473/298 |
| 2,002,535 | A | * | 5/1935 | Gagnier | 473/300 |
| 2,468,202 | A | * | 4/1949 | Karns | 473/300 |
| D164,241 | S | * | 8/1951 | Karns | D21/756 |
| 4,597,578 | A | * | 7/1986 | Lancaster | 473/300 |
| 4,974,846 | A | * | 12/1990 | Fenton | 473/303 |
| 5,686,158 | A | * | 11/1997 | Gibbon | 428/36.92 |
| 5,690,566 | A | * | 11/1997 | Bracho | 473/549 |
| 5,711,720 | A | * | 1/1998 | Janes et al. | 473/300 |
| D530,762 | S | * | 10/2006 | Chen | D21/756 |
| 7,458,903 | B2 | * | 12/2008 | Wang et al. | 473/300 |
| 2004/0031128 | A1 | * | 2/2004 | Chen | 16/436 |
| 2008/0305884 | A1 | * | 12/2008 | Cameron | 473/300 |
| 2009/0075747 | A1 | * | 3/2009 | Kou | 473/300 |

FOREIGN PATENT DOCUMENTS

| | | | |
|---|---|---|---|
| JP | 06246022 | A * | 9/1994 |
| JP | 8-276041 | A | 10/1996 |

* cited by examiner

*Primary Examiner* — Stephen L. Blau
(74) *Attorney, Agent, or Firm* — Birch, Stewart, Kolasch & Birch, LLP

(57) ABSTRACT

A golf club (2) according to the present invention includes a head (4), a shaft (6) and a grip (8). A maximum thickness portion of the grip (8) is present within a range of 3 to 8 mm from a butt end. When the closest position to a tip side in the maximum thickness portion is set to be a reference position (K), a position placed apart from the reference position (K) toward the tip side by 20 mm is set to be a position (A), a position placed apart from the reference position (K) toward the tip side by 30 mm is set to be a position (B), a position placed apart from the reference position (K) toward the tip side by 50 mm is set to be a position (C), and a position placed apart from the reference position (K) toward the tip side by 200 mm is set to be a position (D), a taper ratio (T1) between the reference position (K) and the position (A) is equal to or higher than 0.255 and is equal to or lower than 0.270, a taper ratio (T2) between the position (B) and the position (C) is equal to or higher than 0.045 and is equal to or lower than 0.060, and a taper ratio (T3) between the position (C) and the position (D) is equal to or higher than 0.015 and is equal to or lower than 0.035.

10 Claims, 2 Drawing Sheets

GOLF CLUB AND GRIP FOR GOLF CLUB

This application claims priority on Patent Application No. 2008-142018 filed in JAPAN on May 30, 2008, the entire contents of which are hereby incorporated by reference.

BACKGROUND OF THE INVENTION

1. Field of the Invention

The present invention relates to a golf club and a grip for the golf club.

2. Description of the Related Art

A grip is attached to a golf club. An easiness of gripping and a difficulty of slip are required for the grip.

An outside diameter of the grip is usually increased toward a butt side. The butt side implies a grip end side, that is, a rear end side in the golf club. On the other hand, a tip side implies a tip side in the golf club.

Japanese Laid-Open Patent Publication No. 8-276041 has disclosed a grip in which a taper angle in a predetermined position of the grip is devised and a slip is thus caused with difficulty also in the case in which sweat or rain sticks.

SUMMARY OF THE INVENTION

The present inventor investigated a more excellent grip shape. As a result, it was found that an easiness of gripping and a difficulty of slip can be improved by a grip having a different shape from conventional shapes. The present inventor found a shape of a grip which is particularly suitable for a golf player having no power.

It is an object of the present invention to provide a grip for a golf club which can contribute to an easiness of gripping and an easiness of swinging of the golf club.

A golf club according to the present invention includes a head, a shaft and a grip. A maximum thickness portion of the grip is present within a range of 3 to 8 mm from a butt end. The closest position to a tip side in the maximum thickness portion is set to be a reference position K. A position placed apart from the reference position K toward the tip side by 20 mm is set to be a position A. A position placed apart from the reference position K toward the tip side by 30 mm is set to be a position B. A position placed apart from the reference position K toward the tip side by 50 mm is set to be a position C. A position placed apart from the reference position K toward the tip side by 200 mm is set to be a position D. A taper ratio T1 between the reference position K and the position A is equal to or higher than 0.255 and is equal to or lower than 0.270. A taper ratio T2 between the position B and the position C is equal to or higher than 0.045 and is equal to or lower than 0.060. A taper ratio T3 between the position C and the position D is equal to or higher than 0.015 and is equal to or lower than 0.035.

In a grip for a golf club according to the present invention, a maximum thickness portion of the grip is present within a range of 3 to 8 mm from a butt end. The closest position to a tip side in the maximum thickness portion is set to be a reference position K, a position placed apart from the reference position K toward the tip side by 20 mm is set to be a position A, a position placed apart from the reference position K toward the tip side by 30 mm is set to be a position B, a position placed apart from the reference position K toward the tip side by 50 mm is set to be a position C, and a position placed apart from the reference position K toward the tip side by 200 mm is set to be a position D. At this time, a taper ratio T1 between the reference position K and the position A is equal to or higher than 0.255 and is equal to or lower than 0.270. Moreover, a taper ratio T2 between the position B and the position C is equal to or higher than 0.045 and is equal to or lower than 0.060. A taper ratio T3 between the position C and the position D is equal to or higher than 0.015 and is equal to or lower than 0.035.

Preferably, when a grip thickness in the reference position K is represented by k1, a grip thickness (mm) in the position A is represented by a1, a grip thickness (mm) in the position B is represented by b1, a grip thickness (mm) in the position C is represented by c1, and a grip thickness (mm) in the position D is represented by d1, the following relational expression is established.

$$k1>a1>b1>c1>d1$$

Preferably, the grip thickness k1 is equal to or greater than 27 mm and is equal to or smaller than 32 mm. Preferably, the grip thickness a1 is equal to or greater than 22 mm and is equal to or smaller than 27 mm. Preferably, the grip thickness b1 is equal to or greater than 21 mm and is equal to or smaller than 26 mm. Preferably, the grip thickness c1 is equal to or greater than 20 mm and is equal to or smaller than 25 mm. Preferably, the grip thickness d1 is equal to or greater than 16 mm and is equal to or smaller than 22 mm.

Preferably, a taper ratio T4 between the position A and the position B is equal to or lower than the taper ratio T1 and is equal to or higher than the taper ratio T2.

Preferably, the taper ratio T4 is lower than the taper ratio T1 and is higher than the taper ratio T2.

Preferably, [T1/T2] is equal to or higher than 4.25 and is equal to or lower than 6.00.

Preferably, [T1/T3] is equal to or higher than 7.30 and is equal to or lower than 18.00.

Preferably, [T2/T3] is equal to or higher than 1.30 and is equal to or lower than 4.00.

Preferably, a JIS-A hardness of the grip is equal to or greater than 30 and is equal to or smaller than 70.

By taking a different shape from conventional shapes, an easiness of gripping can be enhanced. By the easiness of gripping, it is possible to achieve a golf club which can readily be swung.

DESCRIPTION OF THE PREFERRED EMBODIMENTS

The present invention will be described below in detail based on preferred embodiments with reference to the drawings.

Figure 1:
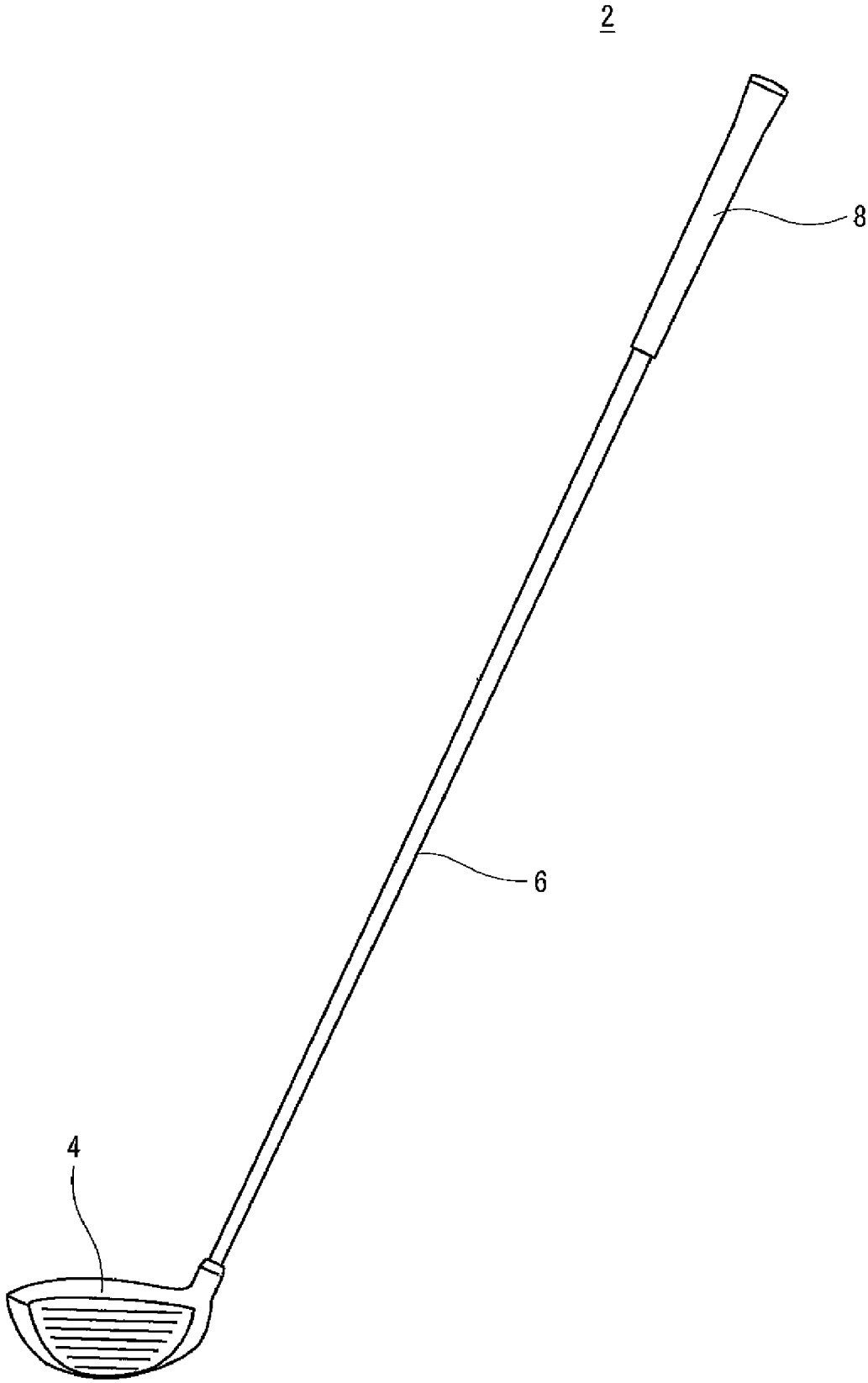
FIG. 1 is a general view showing a golf club according to an embodiment of the present invention.

A golf club 2 shown in FIG. 1 has a golf club head 4, a golf club shaft 6 and a grip 8 for the golf club. The head 4 is attached to one of ends of the shaft 6. The grip 8 is attached to the other end of the shaft 6.

The head 4 is not restricted. Examples of the head 4 include a head of a wood type, a head of an iron type and a putter head. The shaft 6 is not restricted. Examples of the shaft 6 include a so-called steel shaft and a so-called carbon shaft.

Figure 2:
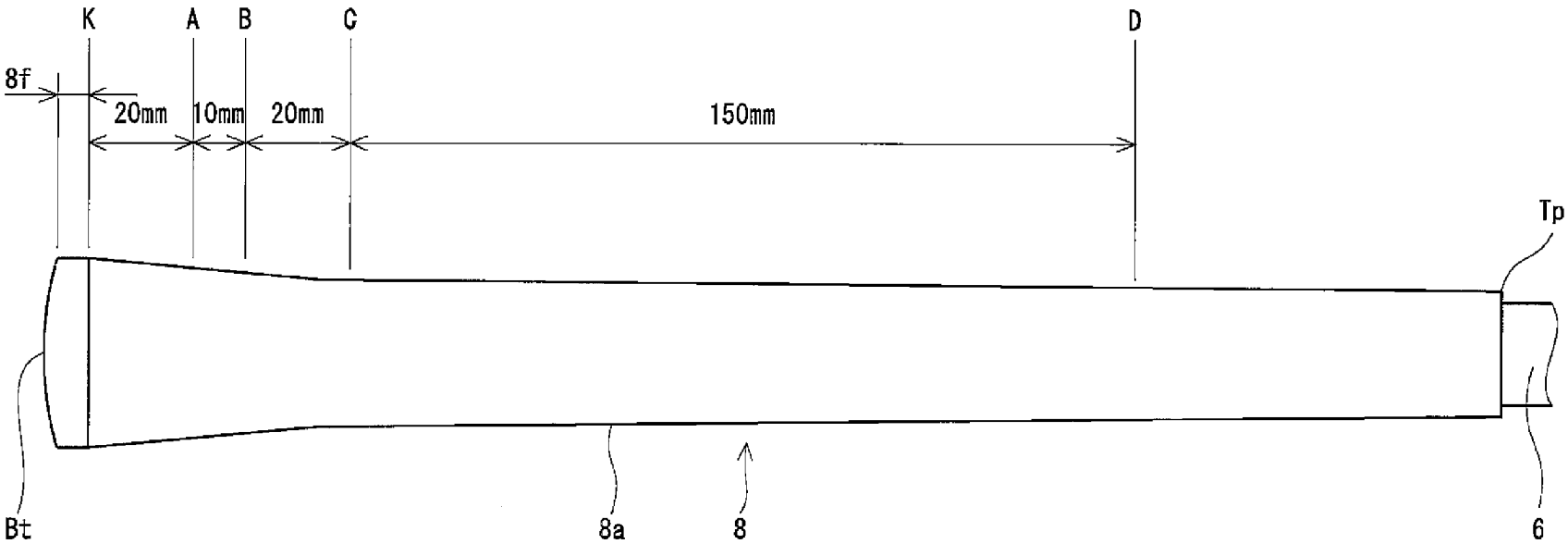
FIG. 2 is an enlarged view showing the vicinity of a grip in the golf club of FIG. 1.

FIG. 2 is an enlarged view showing the grip 8 portion in FIG. 1. Although a groove is formed on an external surface of the grip 8, it is not shown in FIGS. 1 and 2.

The shaft 6 takes a cylindrical shape, which is not shown. The grip Stakes an almost cylindrical shape, which is not shown. The external surface of the grip 8 is a curved surface taking a shape of an almost circumferential surface.

The grip 8 has a so-called back line, which is not shown. Accordingly, a section line D8 of the external surface 8*a* is not completely round in the grip 8 having the shaft 6 inserted therein. The grip 8 does not need to have the so-called back line, in this case, the section line D8 usually takes a circular shape if a dimension error, a groove or the like is disregarded. The section line D8 is an intersection line of the external surface 8*a* of the grip 8 and a perpendicular plane to a shaft axis (a grip axis), which is not shown.

In the present application, a reference position K, a position A, a position B, a position C and a position D are considered as positions in the grip 8. All of these positions imply positions in a direction of the shaft axis. In the present application, a "position" implies a position in an axial direction and a "distance" implies a distance in the axial direction if they are not particularly described. Moreover, an "axial direction" in the golf club implies a direction of a central axis of the shaft and an "axial direction" in the grip implies a direction of a central axis of the grip if they are not particularly described.

In the present application, a grip thickness in each position in the direction of the shaft axis is taken into consideration. In the case in which the section line D8 of the external surface 8*a* of the grip 8 takes a circular shape, the grip thickness is equal to a diameter of the section line D8. In the case in which the section line D8 of the external surface 8*a* of the grip 8 does not take the circular shape, the grip thickness is set to be an average value of a maximum value of an outline width t8 of the grip 8 and a minimum value of the outline width t8 of the grip 8. The outline width t8 of the grip 8 implies a distance (the shortest distance) between a first straight line L1 touching the section line D8 and a second straight line L2 touching the section line D8. The straight line L2 is parallel with the straight line L1 and touches the section line D8 on a different point from the straight line L1. The grip thickness is usually referred to as a diameter of the grip 8 or an outside diameter of the grip 8. In the present application, a term of "grip thickness" is used in consideration of the fact that a sectional shape of the grip is not always circular.

In the present application, a maximum thickness portion 8*f* of the grip 8 is defined. The maximum thickness portion 8*f* has a maximum grip thickness. The maximum thickness portion 8*f* may have a width in the axial direction. In this case, the maximum thickness portion 8*f* can form a portion in which the grip thickness is constant. In the case in which the maximum thickness portion 8*f* has no width in the axial direction, it can form an edge line extended circumferentialy.

In the grip 8, the maximum thickness portion 8*f* is present in a range A1 (not shown) at a distance of 3 to 8 mm from a butt end Bt. The "3 to 8 mm" is a distance in the axial direction. The maximum thickness portion 8*f* may be present in a position in the axial direction which departs from the range A1. In order to set, into a preferable range, a taper ratio which will be described below, it is preferable that the maximum thickness portion 8*f* should not be present on a tip side from the range A1.

As shown in FIG. 2, a grip end is a protruded and curved surface in the grip 8 according to the present embodiment, and the vicinity of an apex of the protruded and curved surface is set to be the butt end Bt.

In the present application, each position of the grip 8 in the axial direction is defined. More specifically, in the present application, the reference position K, the position A, the position B, the position C and the position D are defined as the positions in the axial direction. As shown in FIG. 2, the closest position to a butt side in the maximum thickness portion 8*f* is set to be the reference position K. A position placed apart from the reference position K toward the tip side by 20 mm is set to be the position A. A position placed apart from the reference position K toward the tip side by 30 mm is set to be the position B. A position placed apart from the reference position K toward the tip side by 50 mm is set to be the position C. A position placed apart from the reference position K toward the tip side by 200 mm is set to be the position D.

In the present application, moreover, the grip thickness (mm) in the reference position K is represented by k1. The grip thickness (mm) in the position A is represented by a1. The grip thickness (mm) in the position B is represented by b1. The grip thickness (mm) in the position C is represented by c1. The grip thickness (mm) in the position D is represented by d1. The thickness a1 is greater than the thickness b1. The thickness b1 is greater than the thickness c1. The thickness c1 is greater than the thickness d1. In the grip 8, the following relational expression is established.

$$k1>a1>b1>c1>d1$$

In respect of an easiness of gripping, a preferable range of the grip thickness in each of the positions is as follows. The grip thickness k1 (a lower limit) is preferably equal to or greater than 27 mm, is more preferably equal to or greater than 28 mm and is more preferably equal to or greater than 29 mm. The grip thickness k1 (an upper limit) is equal to or smaller than 32 mm, is more preferably equal to or smaller than 31 mm and is more preferably equal to or smaller than 30 mm. The grip thickness a1 (a lower limit) is preferably equal to or greater than 22 mm, is more preferably equal to or greater than 23 mm and is more preferably equal to or greater than 24 mm. The grip thickness a1 (an upper limit) is equal to or smaller than 27 mm, is more preferably equal to or smaller than 26 mm and is more preferably equal to or smaller than 25 mm. The grip thickness b1 (a lower limit) is preferably equal to or greater than 21 mm, is more preferably equal to or greater than 22 mm and is more preferably equal to or greater than 23 mm. The grip thickness b1 (an upper limit) is preferably equal to or smaller than 26 mm, is more preferably equal to or smaller than 25 mm and is more preferably equal to or smaller than 24 mm. The grip thickness c1 (a lower limit) is preferably equal to or greater than 20 mm, is more preferably equal to or greater than 21 mm and is more preferably equal to or greater than 22 mm. The grip thickness c1 (an upper limit) is equal to or smaller than 25 mm, is more preferably equal to or smaller than 24 mm and is more preferably equal to or smaller than 23 mm. The grip thickness d1 (a lower limit) is preferably equal to or greater than 16 mm, is more preferably equal to or greater than 17 mm and is more preferably equal to or greater than 18.5 mm. The grip thickness d1 (an upper limit) is equal to or smaller than 22 mm, is more preferably equal to or smaller than 21 mm and is more preferably equal to or smaller than 19.5 mm.

In respect of the easiness of gripping, it is preferable that the grip thickness should be decreased gradually or stepwise toward the tip side (the head side) within a range from the reference position K to the position A. As shown in FIG. 2, in the grip 8 according to the present embodiment, the grip thickness is decreased gradually toward the tip side (the head side) within the range from the reference position K to the position A. By the structure, the easiness of gripping is further enhanced.

When the range from the reference position K to the position A is divided into five equal parts in the axial direction and taper ratios within the respective ranges obtained by the division into the five equal parts are represented by T11, T12, T13, T14 and T15 in order from the butt side, the following relational expression is established. By the relationship, the easiness of gripping is further enhanced.

$$T11>T12>T13>T14>T15$$

As will be described below, a taper ratio within a certain range is obtained by subtracting the grip thickness on an end at the tip side within the range from the grip thickness on an end at the butt side within the range and dividing the calculated difference by a length in the axial direction within the range.

In respect of the easiness of gripping, it is preferable that the grip thickness should be decreased gradually or stepwise toward the tip side (the head side) within a range from the position B to the position C. As shown in FIG. 2, in the grip 8 according to the present embodiment, the grip thickness is decreased gradually toward the tip side (the head side) within the range from the position B to the position C. By the structure, the easiness of gripping is further enhanced.

When the range from the position B to the position C is divided into five equal parts in the axial direction and taper ratios within the respective ranges obtained by the division into the five equal parts are represented by T21, T22, T23, T24 and T25 in order from the butt side, the following relational expression is established. By the relationship, the easiness of gripping is further enhanced.

$$T21>T22>T23>T24>T25$$

In respect of the easiness of gripping, it is preferable that the grip thickness should be decreased gradually or stepwise toward the tip side (the head side) within a range from the position C to the position D. As shown in FIG. 2, in the grip 8 according to the present embodiment, the grip thickness is decreased gradually toward the tip side (the head side) within the range from the position C to the position D. By the structure, the easiness of gripping is further enhanced.

When the range from the position C to the position D is divided into five equal parts in the axial direction and taper ratios within the respective ranges obtained by the division into the five equal parts are represented by T31, T32, T33, T34 and T35 in order from the butt side, the following relational expression is established. By the relationship, the easiness of gripping is further enhanced.

$$T31>T32>T33>T34>T35$$

It is preferable that the grip thickness should be decreased gradually or stepwise toward the tip side (the head side) within a range from the position A to the position B. As shown in FIG. 2, in the grip 8 according to the present embodiment, the grip thickness is decreased gradually toward the tip side (the head side) within the range from the position A to the position B. By the structure, the easiness of gripping is further enhanced.

When the range from the position A to the position B is divided into five equal parts in the axial direction and taper ratios within the respective ranges obtained by the division into the five equal parts are represented by T41, T42, T43, T44 and T45 in order from the butt side, the following relational expression is established. By the relationship, the easiness of gripping is further enhanced.

$$T41>T42>T43>T44>T45$$

Although a range from the position D to a tip end Tp is usually provided out of a range to be mainly gripped, it can be gripped mainly in the case in which the club is held to be short, or the like. In respect of the easiness of gripping, it is preferable that the grip thickness should be constant or decreased gradually toward the tip side (the head side) within the range from the position D to the tip end Tp.

In the present invention, the taper ratio in each of the positions is taken into consideration. A taper ratio T1 between the reference position K and the position A is calculated in accordance with the following equation.

$$T1=(k1-a1)/20$$

A taper ratio T2 between the position B and the position C is calculated in accordance with the following equation.

$$T2=(b1-c1)/20$$

A taper ratio T3 between the position C and the position D is calculated in accordance with the following equation.

$$T3=(c1-d1)/150$$

A taper ratio T4 between the position A and the position B is calculated in accordance with the following equation.

$$T4=(a1-b1)/10$$

A taper ratio T5 between the position D and the tip end Tp is calculated in accordance with the following equation.

$$T5=(d1-e1)/X$$

e1 represents a grip thickness on the tip end Tp and X represents a length in the axial direction from the position D to the tip end Tp.

In respect of the easiness of gripping, the taper ratio T1 is preferably equal to or higher than 0.255 and is more preferably equal to or higher than 0.260. In respect of the easiness of gripping, the taper ratio T1 is preferably equal to or lower than 0.270.

In respect of the easiness of gripping, the taper ratio T2 is preferably equal to or higher than 0.045 and is more preferably equal to or higher than 0.050. In respect of the easiness of gripping, the taper ratio T2 is preferably equal to or lower than 0.060 and is more preferably equal to or lower than 0.055.

In respect of the easiness of gripping, the taper ratio T3 is preferably equal to or higher than 0.015 and is more preferably equal to or higher than 0.020. In respect of the easiness of gripping, the taper ratio T3 is preferably equal to or lower than 0.035 and is more preferably equal to or lower than 0.030.

In respect of the easiness of gripping, it is preferable that the taper ratio T4 should be equal to or lower than the taper ratio T1 and should be equal to or higher than the taper ratio T2. In respect of the easiness of gripping, it is more preferable that the taper ratio T4 should be lower than the taper ratio T1 and should be higher than the taper ratio T2.

In respect of the easiness of gripping, it is preferable that the taper ratio T5 should be equal to or lower than the taper ratio T3. In respect of the easiness of gripping, it is preferable that the taper ratio T5 should be lower than the taper ratio T3.

As described above, in the present invention, the taper ratios T1, T2 and T3 have a relationship of "T1>T2>T3". The structure contributes to the easiness of gripping. In the case in which "T1=T2>T3" is set, a portion from the reference position K to the position C has a thickness increased excessively. In particular, a golf player having a small hand (a female golf player or the like) tends to carry out gripping with difficulty. In the case in which "T1>T2=T3" is set, moreover, a portion from the position B to the position D has an excessively small thickness and the gripping tends to be difficult. In the case in which the portion from the position B to the position D has the excessively small thickness, a swing using a wrist excessively tends to be carried out so that a missed hit might be caused. By setting "T1>T2>T3", it is possible to carry out firm gripping without an uncomfortable feeling. Thus, a head speed can be enhanced.

It has been known that firm gripping is preferably carried out by a reverse hand to a dominant hand in a golf swing. For example, in case of a right-handed golf player, it is preferable that the gripping should be firmly carried out by a left hand. By the grip shape according to the present invention, suitable gripping for the golf swing can easily be implemented. Moreover, the present invention particularly provides a more suitable grip shape for a golf player having no power.

In order to prevent the thickness of the portion from the reference position K to the position C from being excessively increased, [T1/T2] is preferably equal to or higher than 4.25, is more preferably equal to or higher than 4.40 and is more preferably equal to or higher than 4.50. In order to prevent the thickness of the portion from the position B to the position C from being excessively reduced, [T1/T2] is preferably equal to or lower than 6.00, is more preferably equal to or lower than 5.80 and is more preferably equal to or lower than 5.70.

In the case in which the thickness of the portion from the reference position K to the position A is extremely different from the thickness of the portion from the position C to the portion D, an uncomfortable feeling tends to be made in senses of left and right hands in the gripping. In order to suppress the uncomfortable feeling, [T1/T3] is preferably equal to or higher than 7.30, is more preferably equal to or higher than 7.50 and is more preferably equal to or higher than 7.70. In order to prevent the thickness of the portion from the reference position K to the position A from being excessively reduced, [T1/T3] is preferably equal to or lower than 18.00, is more preferably equal to or lower than 17.50 and is more preferably equal to or lower than 17.00.

In respect of the easiness of gripping, [T2/T3] is preferably equal to or higher than 1.30, is more preferably equal to or higher than 1.50 and is more preferably equal to or higher than 1.70. In order to enhance an adaptability to a golf rule, [T2/T3] is preferably equal to or lower than 4.00, is more preferably equal to or lower than 3.50 and is more preferably equal to or lower than 3.00.

A material of the grip is not restricted and examples of the material include a rubber composition and a resin composition. As a rubber in the rubber composition, for example, it is possible to use a natural rubber (NR), an ethylene-propylene-diene rubber (EPDM), a styrene-butadiene rubber (SBR), an isoprene rubber (IR), a butadiene rubber (BR), a chloroprene rubber (CR), an acrylonitrile-butadiene rubber (NBR) or the like. In particular, it is preferable to use the natural rubber or a rubber obtained by blending (mixing), with the natural rubber, the ethylene-propylene-diene rubber, the styrene-butadiene rubber or the like which has an excellent affinity for the natural rubber.

Oil may be blended with the rubber composition. As the oil, for example, it is possible to use aromatic based oil, naphthene based oil, paraffin based oil or the like.

For example, it is also possible to properly blend a reinforcing agent, a filler, a vulcanization accelerator, a vulcanization assistant or the like with the rubber composition of the grip if necessary in addition to the rubber, sulfur and the oil. Furthermore, an anti-aging agent, a processing assistant, or the like may be blended.

As the reinforcing agent, for example, it is possible to use carbon, silica or the like. As the filler, for example, hard clay, calcium carbonate, magnesium carbonate, clay or the like is used. As the vulcanization assistant, for example, zinc oxide, stearic acid or the like is used. The vulcanization acceleration can be properly selected corresponding to a rubber to be used in accordance with a well-known method.

For a material of the grip, it is also possible to use a resin composition. Examples of a resin contained in the resin composition include a thermoplastic resin. The thermoplastic resin can be used in injection molding. For the thermoplastic resin, a thermoplastic elastomer is preferable and a thermoplastic elastomer containing a soft segment and a hard segment is more preferable. In respect of a compatibility of a gripping property and an abrasion resistance, an urethane based thermoplastic elastomer is more preferable.

A preferable blending ratio to 100 parts by weight of the rubber contains 5 to 70 parts by weight of the reinforcing agent, 10 to 70 parts by weight of the filler, 0.1 to 3 parts by weight of the vulcanization accelerator, and 1 to 10 parts by weight of the vulcanization assistant. The ratios are not restricted.

A process for the grip 8 is not restricted. The grip 8 can be manufactured by a well-known process. Examples of the process include press molding and injection molding.

In the press molding, a rubber composition is filled in a metal mold and is thus pressurized and heated. Although a heating temperature is usually set to be 130 to 200° C., it is not restricted thereto. Although a time required for the heating is usually set to be 3 to 15 minutes, it is not restricted thereto.

In order to suppress an excessive deformation of the grip, and particularly, to enhance the griping property in drying, a JIS-A hardness of the grip is preferably equal to or greater than 30, is more preferably equal to or greater than 35 and is particularly preferably equal to or greater than 40. In order to prevent a grip feeling from being excessively hard and to enhance the gripping property in wetting, the JIS-A hardness of the grip is preferably equal to or smaller than 70, is more preferably equal to or smaller than 60 and is particularly preferably equal to or smaller than 50. The JIS-A hardness is measured in accordance with the provisions of the JIS-K-6253.

In the present invention related to the golf club, a grip dimension such as the grip thickness is measured in a state of the golf club, that is, a state in which the shaft is inserted. In the present invention related to the grip, the grip dimension such as the grip thickness is measured in a state of the single grip. By the insertion of the shaft, in some cases, the grip thickness is slightly larger as compared with the case in which the shaft has not been inserted. The taper ratio such as the taper ratio T1, the taper ratio T2 or the taper ratio T3 is rarely changed before and after the insertion of the shaft.

EXAMPLES

Although the advantages of the present invention will be apparent from examples, the present invention should not be construed restrictively based on description of the examples.

Example 1

A natural rubber (NR) and an ethylene-propylene-diene rubber (EPDM) were blended in a weight ratio of 65:35, and furthermore, sulfur, carbon black and an inorganic component were properly blended so that a rubber composition was obtained. The rubber composition was filled in a press mold and was pressurized for 10 minutes at a temperature of 150° C. so that a vulcanized grip was obtained. As a golf club for a test, a driver of "XXIO" (trade name) (a loft of 10.5 degrees, shaft MP-500, a shaft hardness R) manufactured by SRI Sports Co., Ltd. was used. A grip attached to the "XXIO" driver on a standard basis was removed and the grip fabricated as described above was attached so that a golf club according to an example 1 was obtained. In the golf club, a dimension of the grip is shown in the following Table 1. A specification and an evaluation result in the example 1 are shown in the following Table 1.

Examples 2 to 4 and Comparative Examples 1 to 3

A golf club according to each of examples 2 to 4 and comparative examples 1 to 3 was obtained in the same manner as in the example 1 except that a dimension of a grip was set as shown in the Table 1. Specifications and evaluation results are shown in the following Table 1.

[Evaluating Method]

An evaluation was carried out for four items including "an easiness of gripping", "an easiness of swinging", "a flight distance" and "a directivity". Ten testers carries out ten hitting operations respectively with each club so that the evaluation was performed. Each of the ten testers is a golf player who has a head speed of 35 to 42 (m/s) with a driver and is in a beginner's class or an intermediate class. The "XXIO XD" (trade name) manufactured by the SRI Sports Co., Ltd. was used for a ball. The ball is a three-piece solid golf ball. The details of each evaluation are as follows.

[Evaluation of Easiness of Gripping]

An easiness of gripping in the grip and swing of each club was subjected to a sensory evaluation in ten grades of one to ten marks. An average value of the evaluation marks for all of the testers is shown in the following Table 1. If the evaluation mark is greater, the evaluation is more excellent.

[Evaluation of Easiness of Swinging]

An easiness of swinging in the grip and swing of each club was subjected to a sensory evaluation in ten grades of one to ten marks. An average value of the evaluation marks for all of the testers is shown in the following Table 1. If the evaluation mark is greater, the evaluation is more excellent.

[Evaluation of Flight Distance]

A flight distance in each hitting operation was measured so that 100 flight distance data in total were obtained. The flight distance was measured based on a final reaching point of a ball. The data were averaged and the average value was indexed with the average value in the example 2 set to be 100. The index is shown in the following Table 1. If the index is greater, the flight distance is longer.

[Evaluation of Directivity (Evaluation of Directional Stability)]

A directivity shift in each hitting operation was measured so that 100 data in total were obtained. The directivity shift implies a distance between a line connecting a target point to a hitting point and a final reaching point of a ball. Irrespective of a right or left shift, the directivity shift was set to have a positive value. The data were averaged and an inverse number of the average value was indexed with the average value in the example 2 set to be 100. The index is shown in the following Table 1. If the index is greater, the directivity is more excellent.

TABLE 1

Specification and Evaluation Result according to Example and Comparative Example

| | Unit | Example 1 | Example 2 | Example 3 | Example 4 | Comparative Example 1 | Comparative Example 2 | Comparative Example 3 |
|---|---|---|---|---|---|---|---|---|
| Grip Thickness k1 | mm | 29.7 | 29.7 | 29.7 | 29.7 | 28.0 | 28.0 | 28.0 |
| Grip Thickness a1 | mm | 24.5 | 24.5 | 24.4 | 24.3 | 26.2 | 26.5 | 26.9 |
| Grip Thickness b1 | mm | 23.6 | 23.5 | 23.3 | 23.9 | 25.3 | 25.5 | 25.8 |
| Grip Thickness c1 | mm | 22.7 | 22.5 | 22.2 | 22.7 | 23.5 | 23.6 | 24.0 |
| Grip Thickness d1 | mm | 20.5 | 19.5 | 18.5 | 17.5 | 18.5 | 19.2 | 19.6 |
| Taper Ratio T1 | mm/mm | 0.260 | 0.260 | 0.265 | 0.270 | 0.090 | 0.075 | 0.055 |
| Taper Ratio T2 | mm/mm | 0.045 | 0.050 | 0.055 | 0.060 | 0.090 | 0.095 | 0.090 |
| Taper Ratio T3 | mm/mm | 0.015 | 0.020 | 0.025 | 0.035 | 0.033 | 0.029 | 0.029 |
| T1/T2 | — | 5.78 | 5.20 | 4.82 | 4.50 | 1.00 | 0.79 | 0.61 |
| T1/T3 | — | 17.73 | 13.00 | 10.74 | 7.79 | 2.70 | 2.56 | 1.88 |
| T2/T3 | — | 3.07 | 2.50 | 2.23 | 1.73 | 2.70 | 3.24 | 3.07 |
| Easiness of Gripping | — | 8.5 | 9.3 | 9.5 | 8.5 | 6.8 | 6.8 | 6.5 |
| Easiness of Swinging | — | 8.8 | 9.6 | 9.8 | 9.0 | 5.0 | 5.2 | 4.8 |
| Flight Distance (Index) | — | 99 | 100 | 101 | 101 | 97 | 89 | 88 |
| Directivity (Index) | — | 98 | 100 | 100 | 99 | 75 | 72 | 70 |

As shown in the Table 1, the examples have more excellent evaluations than the comparative examples. From the results of the evaluation, advantages of the present invention are apparent.

The present invention can be applied to grips of all golf clubs.

The above description is only illustrative and various changes can be made without departing from the scope of the present invention.

What is claimed is:

1. A golf club comprising a head, a shaft and a grip, wherein a maximum thickness portion of the grip is present within a range of 3 to 8 mm from a butt end, and when the closest position to a tip side in the maximum thickness portion is set to be a reference position K, a position placed apart from the reference position K toward the tip side by 20 mm is set to be a position A, a position placed apart from the reference position K toward the tip side by 30 mm is set to be a position B, a position placed apart from the reference position K toward the tip side by 50 mm is set to be a position C, and a position placed apart from the reference position K toward the tip side by 200 mm is set to be a position D, a taper ratio T1 between the reference position K and the position A is equal to or higher than 0.255 and is equal to or lower than 0.270, a taper ratio T2 between the position B and the position C is equal to or higher than 0.045 and is equal to or lower than 0.060, and a taper ratio T3 between the position C and the position D is equal to or higher than 0.015 and is equal to or lower than 0.035; and wherein the grip thickness (mm) in the reference position K is represented by k1, the grip thickness (mm) in the reference position A is represented by a1, the grip thickness (mm) in the reference position B is represented by b1, the grip thickness (mm) in the reference position C is represented by c1, and the grip thickness (mm) in the reference position D is represented by d1, such that:

$$T1=(k1-a1)/20,$$

$$T2=(b1-c1)/20, \text{ and}$$

$$T3=(c1-d1)/150.$$

2. The golf club according to claim 1, wherein the following relational expression is established:

$$k1>a1>b1>c1>d1$$

3. The golf club according to claim 2, wherein the grip thickness k1 is equal to or greater than 27 mm and is equal to or smaller than 32 mm, the grip thickness a1 is equal to or greater than 22 mm and is equal to or smaller than 27 mm, the grip thickness b1 is equal to or greater than 21 mm and is equal to or smaller than 26 mm, the grip thickness c1 is equal to or greater than 20 mm and is equal to or smaller than 25 mm, and the grip thickness d1 is equal to or greater than 16 mm and is equal to or smaller than 22 mm.

4. The golf club according to claim 1, wherein a taper ratio T4 between the position A and the position B is equal to or lower than the taper ratio T1 and is equal to or higher than the taper ratio T2 and wherein T4=(a1−b1)/10.

5. The golf club according to claim 4, wherein the taper ratio T4 is lower than the taper ratio T1 and is higher than the taper ratio T2.

6. The golf club according to claim 1, wherein [T1/T2] is equal to or higher than 4.25 and is equal to or lower than 6.00.

7. The golf club according to claim 1, wherein [T1/T3] is equal to or higher than 7.30 and is equal to or lower than 18.00.

8. The golf club according to claim 1, wherein [T2/T3] is equal to or higher than 1.30 and is equal to or lower than 4.00.

9. The golf club according to claim 1, wherein a JIS-A hardness of the grip is equal to or greater than 30 and is equal to or smaller than 70.

10. A grip for a golf club wherein a maximum thickness portion of the grip is present within a range of 3 to 8 mm from a butt end, and when the closest position to a tip side in the maximum thickness portion is set to be a reference position K, a position placed apart from the reference position K toward the tip side by 20 mm is set to be a position A, a position placed apart from the reference position K toward the tip side by 30 mm is set to be a position B, a position placed apart from the reference position K toward the tip side by 50 mm is set to be a position C, and a position placed apart from the reference position K toward the tip side by 200 mm is set to be a position D, a taper ratio T1 between the reference position K and the position A is equal to or higher than 0.255 and is equal to or lower than 0.270, a taper ratio T2 between the position B and the position C is equal to or higher than 0.045 and is equal to or lower than 0.060, and a taper ratio T3 between the position C and the position D is equal to or higher than 0.015 and is equal to or lower than 0.035, and wherein the grip thickness (mm) in the reference position K is represented by k1, the grip thickness (mm) in the reference position A is represented by a1, the grip thickness (mm) in the reference position B is represented by b1, the grip thickness (mm) in the reference position C is represented by c1, the grip thickness (mm) in the reference position D is represented by d1, such that:

$$T1=(k1-a1)/20,$$

$$T2=(b1-c1)/20, \text{ and}$$

$$T3=(c1-d1)/150.$$

* * * * *